United States Patent [19]

Hempstead-Harris

[11] Patent Number: 4,969,894

[45] Date of Patent: Nov. 13, 1990

[54] STRETCHABLE PACIFIER RETAINER HARNESS

[76] Inventor: Doris K. Hempstead-Harris, 3664 N. Bancroft, Indianapolis, Ind. 46220

[21] Appl. No.: 329,546

[22] Filed: Mar. 28, 1989

[51] Int. Cl.[5] ..... A61J 17/00

[52] U.S. Cl. ..... 606/234

[58] Field of Search ..... 128/359, 360, 206.13, 128/206.17, 163, 169, 858, 859, 205.25, 206.13; 606/234–236; 24/16 PB, 17 B, 482

[56] References Cited

U.S. PATENT DOCUMENTS

| | | | |
|---|---|---|---|
| 1,287,295 | 12/1918 | Guenther . | |
| 2,827,055 | 3/1958 | Carden | 128/359 |
| 2,834,350 | 11/1958 | Beck, Jr. et al. | 128/360 |
| 3,392,729 | 7/1968 | Lenoir | 128/360 |
| 4,329,996 | 5/1982 | Copeland | 128/359 |
| 4,351,331 | 9/1982 | Gereg | 128/207 |
| 4,697,589 | 10/1987 | King et al. | 128/359 |
| 4,790,307 | 12/1988 | Haber et al. | 128/206.13 |
| 4,815,456 | 3/1989 | Rubin et al. | 128/206.13 |

*Primary Examiner*—C. Fred Rosenbaum
*Assistant Examiner*—William W. Lewis
*Attorney, Agent, or Firm*—Barnes & Thornburg

[57] ABSTRACT

A stretchable pacifier retainer or holder includes a one-piece strap made of elastic material with its respective ends forming a loop to be attached to or engaged with the ears of a baby for holding pacifier in the baby's mouth. The one-piece elastic strap is threaded through one or more orifices in the base of the pacifier.

13 Claims, 1 Drawing Sheet

STRETCHABLE PACIFIER RETAINER HARNESS

BACKGROUND AND SUMMARY OF THE INVENTION

The present invention relates to a pacifier holder or harness, and in particular to a stretchable retainer for yieldably biasing a pacifier gently into the mouth of a child.

It has been observed that small children often allow a pacifier to fall out of their mouths inadvertently onto the floor or other nearby surface. Not surprisingly, the child will begin to cry as soon as it loses its pacifier. A child could also be exposed to an unsanitary pacifier unless the pacifier is cleaned thoroughly after it is dropped and before it is returned to the child's mouth.

One object of the present invention is to provide a harness or other means for very gently and yieldably holding a pacifier in the mouth of a small child.

According to the present invention, a stretchable retainer is provided for yieldably biasing a pacifier into the mouth of a child. The stretchable retainer includes a one-piece, elongated, elastic strap having a stretchable anchoring member at each of its distal ends and a single, stretchable, pacifier-supporting strip interconnecting the anchoring members. Each anchoring member is formed to include an ear-receiving aperture configured to receive a child's ear therein so that each anchoring member can be quickly and easily attached to the child. Once in place the elastic strap stretches about the child's face to yieldably bias a pacifier coupled to the pacifier-supporting strip gently into the child's mouth.

In preferred embodiments, the one-piece, elongated, elastic strap is made of elastic sheet material such as a stretchable double-knit fabric. Illustratively, the pacifier coupled to the stretchable retainer includes a web formed to include two apertures arranged in spaced-apart relation and a nipple coupled to the web and situated between the two apertures. The elastic strap is threaded through both of the apertures to couple the pacifier to the pacifier-supporting strip and to arrange the two anchoring members in spaced-apart relation straddling the pacifier.

The elastic strap is made of a compressible material to permit one of the anchoring members to be compressed and passed through both of the apertures formed in the pacifier web. The elastic strap is thus threaded through said apertures to connect the pacifier web to the pacifier-supporting strip of the elastic strap.

Advantageously, the pacifier retainer of the present invention is made of a sheet material that is so flexible and stretchable that the pacifier could, if necessary, be removed by the infant or toddler without assistance. The stretchability of the pacifier retainer allows a small child to cry without gagging. A parent can carry the pacifier retainer anywhere conveniently because of its small size. Further, it is adaptable for use as a retainer with virtually any pacifier on the market because most pacifiers are already formed to include a pair of apertures on opposite sides of the nipple.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
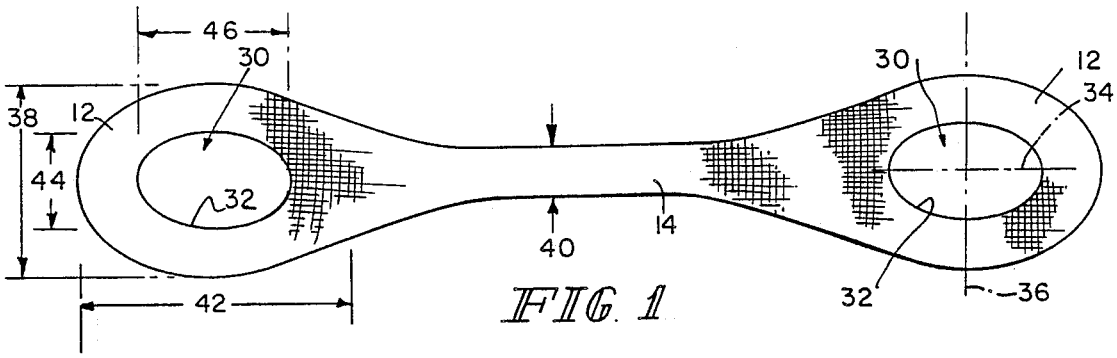
FIG. 1 is a plan view of an embodiment of a stretchable retainer in accordance with the invention.

A stretchable harness retainer 10 of the type shown in FIG. 1 is usable to hold a baby pacifier in the mouth of an infant or toddler in a gentle manner. Retainer 10 is made by cutting a single piece of thin, flat, elastic sheet material to provide a one-piece elongated strap having an anchoring member or ear loop 12 at each of its opposite distal ends and a narrow pacifier-supporting strip 14 interconnecting the spaced-apart anchoring members 12.

Figure 2:
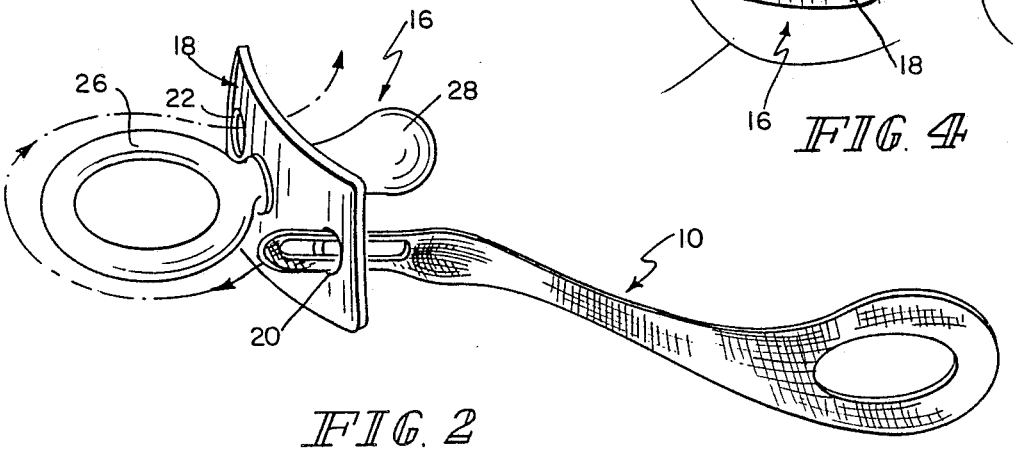
FIG. 2 is a perspective view of the stretchable retainer of FIG. 1 as it is being coupled to a pacifier.

Stretchable retainer or strap 10 can be attached easily to a baby pacifier 16 having a web 18 that is formed to include a pair of spaced-apart apertures 20, 22, for example, in the manner shown in FIG. 2. The middle strip 14 of retainer 10 is connected to pacifier web 18 by threading retainer 10 through the first and second apertures 20, 22 formed in the pacifier web. In the illustrated embodiment, a portion of middle strip 14 lies on an outer wall 24 of pacifier web 18 underneath a conventional pull ring 26, and an ear loop 12 hangs from each side of the pacifier 16. A nipple 28 is also attached to an inner wall of the pacifier 16 as shown in FIG. 2.

Referring to FIG. 1, it will be seen that each anchoring member 12 is oval-shaped and formed to include an oval-shaped aperture 30 for receiving a child's ear therein. An inner edge 32 of each anchoring member 12 defines the boundary of each aperture 30. As shown on the right side of FIG. 1, each oval-shaped anchoring member 12 has a major axis 34 parallel to the longitudinal axis of the pacifier-supporting strip 14 and a minor axis 36 perpendicular to the longitudinal axis of the pacifier-supporting strip 14.

The size of the anchoring members 12 in comparison to the size of the pacifier-supporting strip 14 can be described making reference to the minor and major axes of the oval-shaped anchoring members 12. Each oval-shaped anchoring member 12 has a width 38 measured along its minor axis 36 that is about three times larger than the width 40 of the pacifier-supporting strip 14 and a length 42 measured along its major axis 34 that is about four times larger than the width 40 of strip 14. Also, the oval-shaped inner edge 32 defining each ear-receiving aperture 30 has a width 44 measured along its minor axis 36 that is about one and one-half times larger than the width 40 of strip 14 and a length 46 measured along its major axis 34 that is about two and one-half times larger than the width 40 of strip 14. Further, the overall length of retainer 10 is about twice the length of strip 14.

In a preferred embodiment, the stretchable retainer 10 is made of an elastic double-knit material which is stretchable in at least two mutually perpendicular directions. Illustratively, stretchable retainer 10 is an asymmetrically knit material that stretches more along its length than it does across its width under the same applied load. Essentially, such a material exhibits a first tensile strength, when the retainer 10 is loaded in a longitudinal direction parallel to both of the major axes 34, that is greater than the magnitude of a second tensile strength exhibited by the asymmetrically knit material when the retainer 10 is loaded in a transverse direction parallel to both of the minor axes 36. Accordingly, the elastic range of the retainer 10 is greater under a tensile load applied to retainer 10 along the longitudinal direction 34 than under a tensile load applied to retainer along the transverse direction.

Figure 3:
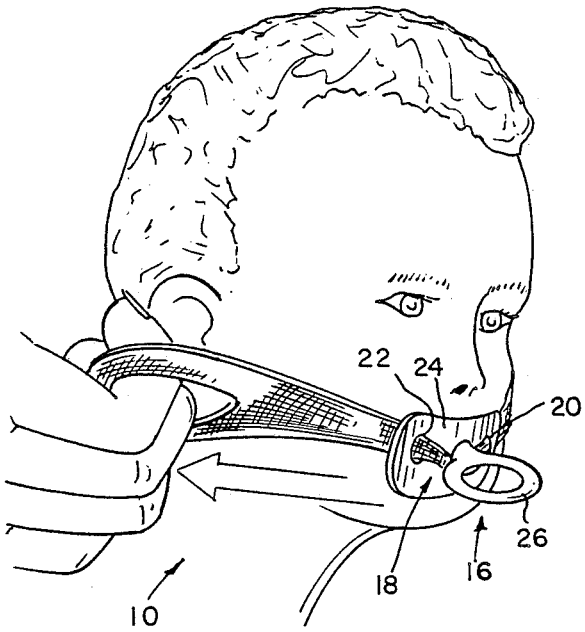
FIG. 3 is a perspective view of a pacifier assembly during coupling of the stretchable retainer to one of a child's ears after the pacifier has already been placed in the child's mouth.
Figure 4:
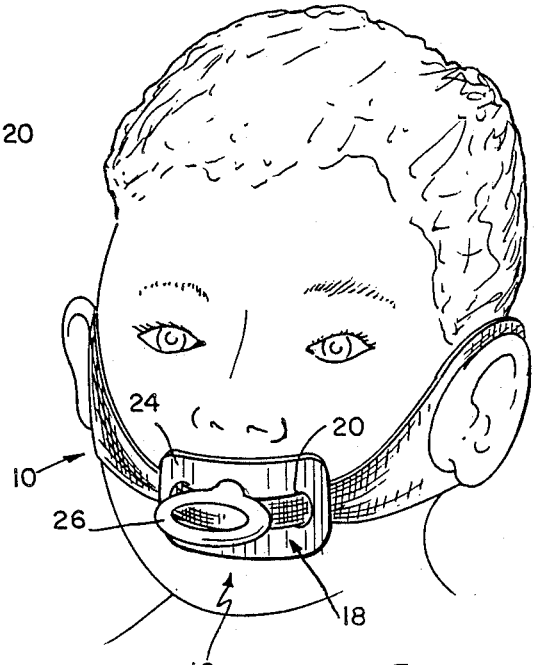
FIG. 4 is another perspective view of the pacifier assembly of FIG. 3 in place to yieldably bias the pacifier gently into the child's mouth.

The pacifier assembly 10, 16 is easily placed on a child as shown in FIG. 3 by first inserting one of the child's ears into the ear-receiving aperture 30 formed in one of the anchoring members 12, stretching the retainer 10 slightly to allow the nipple 28 of pacifier 16 to be inserted into the child's mouth, and then stretching the retainer 10 slightly to hook the other anchoring member 12 over the child's other ear. The final mounted position of pacifier assembly 10, 16 is illustrated in FIG. 4. Essentially, the ends 12 of the retainer strap 10 are looped over the child's ears to hold the pacifier 16 in place.

Although the invention has been described in detail with reference to certain preferred embodiments, variations and modifications exist within the scope and spirit of the invention as described and defined in the following claims.

What is claimed is:

1. A stretchable retainer for yieldably biasing a pacifier into the mouth of a child, the stretchable retainer comprising a one-piece, elongated, elastic strap having a stretchable anchoring member at each of its distal ends and a single, stretchable, pacifier-supporting strip interconnecting the anchoring members, each anchoring member being formed to include an ear-receiving aperture configured to receive a child's ear therein to attach said each anchoring member to the child so that the elastic strap stretches about the child's face to yieldably bias a pacifier coupled to the pacifier-supporting strip into the child's mouth upon attachment of both of the anchoring members to the child's ears, wherein the one-piece, elongated, elastic strap is a thin flat sheet and each of the anchoring members is oval-shaped and has a minor axis having a dimension that is greater than the width of the pacifier-supporting strip.

2. The stretchable retainer of claim 1, wherein the dimension of the minor axis of each of the oval-shaped anchoring members is about three times larger than the width of the pacifier-supporting strip;

3. The stretchable retainer of claim 1, wherein each of the oval-shaped anchoring members has a major axis having a dimension that is about four times larger than the width of the pacifier-supporting strip.

4. The stretchable retainer of claim 1, wherein each anchoring member includes an oval-shaped inner edge defining the ear-receiving aperture and the oval-shaped inner edge has a minor axis having a dimension that is about one and one-half times larger than the width of the pacifier-supporting strip.

5. The stretchable retainer of claim 1, wherein each anchoring member includes an oval-shaped inner edge defining the ear-receiving aperture and the oval-shaped inner edge has a major axis having a dimension that is about two and one-half times larger than the width of the pacifier-supporting strip.

6. The stretchable retainer of claim 1, wherein each of the oval-shaped anchoring members has a major axis and the one-piece, elongated, elastic strap is made of a fabric that is stretchable in a longitudinal direction parallel to both of the major axes of the oval-shaped anchoring members and in a transverse direction parallel to both of the minor axes of the oval-shaped anchoring members.

7. The stretchable retainer of claim 6, wherein the fabric is a double-knit material.

8. The stretchable retainer of claim 6, wherein the stretchable fabric is an asymmetrically knit material that exhibits a first tensile strength when the elastic strap is loaded in said longitudinal direction having a magnitude that is greater than the magnitude of a second tensile strength exhibited by the asymmetrically knit material when the elastic strap is loaded in said transverse direction so that the elastic range of the elastic strap is greater under a tensile load applied to the elastic strap along said longitudinal direction than under a tensile load applied to the elastic strap along said transverse direction.

9. A stretchable retainer for yieldably biasing a pacifier into the mouth of a child, the stretchable retainer comprising a one-piece, elongated, elastic strap having a stretchable anchoring member at each of its distal ends and a single, stretchable, pacifier-supporting strip interconnecting the anchoring members, each anchoring member being formed to include an ear-receiving aperture configured to receive a child's ear therein to attach said each anchoring member to the child so that the elastic strap stretches about the child's face to yieldably bias a pacifier coupled to the pacifier-supporting strip into the child's mouth upon attachment of both of the anchoring members to the child's ears, wherein the one-piece, elongated, elastic strap is made of elastic sheet material, wherein the elastic sheet material is a stretchable double-knit fabric.

10. A combined stretchable retainer and pacifier combination wherein the retainer yieldably biases a pacifier into the mouth of a child, the pacifier including a web formed to include two apertures arranged in spaced-apart relation and a nipple coupled to the web and situated between the two apertures;

wherein the stretchable retainer comprises:

a one piece elongated stretchable elastic strap formed to include an ear-receiving loop at each of its distal ends and a single pacifier-supporting band interconnecting the ear-receiving loops, the single pacifier-supporting band being configured to extend through the two apertures formed in the web to connect the elastic strap to the pacifier so that the elastic strap yieldably biases the pacifier into the child's mouth upon connection of its pacifier-supporting band to the pacifier web and engagement of both of the ear-receiving loops over the child's ears; and wherein the one piece elastic strap is made of a stretchable sheet material of double knit fabric.

11. A combined stretchable retainer and pacifier combination wherein the retainer yieldably biases a pacifier into the mouth of a child, the pacifier including a web formed to include two apertures arranged in spaced-apart relation and a nipple coupled to the web and situated between the two apertures;

wherein the stretchable retainer comprises:

a one piece elongated stretchable elastic strap formed to include an ear-receiving loop at each of its distal ends and a single pacifier-supporting band interconnecting the ear-receiving loops, the single pacifier-supporting band being configured to extend through the two apertures formed in the web to connect the elastic strap to the pacifier so that the elastic strap yieldably biases the pacifier into the child's mouth upon connection of its pacifier-supporting band to the pacifier web and engagement of both of the ear-receiving loops over the child's ears;

and wherein the one-piece, elongated, elastic strap is a thin flat sheet and each of the anchoring members is oval-shaped and has a minor axis having a dimension that is greater than the width of the pacifier-supporting strip.

12. The stretchable retainer of claim 11, wherein the elastic strap includes an annular inner edge defining an aperture in the ear-receiving loop.

13. The stretchable retainer of claim 13, wherein elastic strap is made of a compressible material to permit one of the ear-receiving loops to be compressed and passed through both of the apertures formed in the pacifier web as the elastic strap is threaded through said apertures to connect the pacifier web to the pacifier-supporting band of the elastic strap.

* * * * *

UNITED STATES PATENT AND TRADEMARK OFFICE

CERTIFICATE OF CORRECTION

PATENT NO. : 4,969,894

DATED : November 13, 1990

INVENTOR(S) : Doris K. Hempstead-Harris

It is certified that error appears in the above-identified patent and that said Letters Patent is hereby corrected as shown below:

Column 6, line 11 (claim 13), change "of claim 13," to --of claim 11,--.

Column 6:
Add claims 14 and 15 which were omitted by the Patent Office on the printed patent as follows:

14. The stretchable retainer of claim 10, wherein the elastic strap includes an annular inner edge defining an aperture in the ear-receiving loop.

15. The stretchable retainer of claim 10, wherein the elastic strap is made of a compressible material to permit one of the ear-receiving loops to be compressed and passed through both of the apertures formed in the pacifier web as the elastic strap is threaded through said apertures to connect the pacifier web to the pacifier-supporting band of the elastic strap.

Signed and Sealed this

Eighteenth Day of August, 1992

*Attest:*

DOUGLAS B. COMER

*Attesting Officer*

*Acting Commissioner of Patents and Trademarks*